United States Patent [19]

Russell et al.

[11] Patent Number: 4,535,429

[45] Date of Patent: Aug. 13, 1985

[54] APPARATUS FOR SIGNALLING WITHIN A BOREHOLE WHILE DRILLING

[75] Inventors: Anthony W. Russell; Michael K. Russell, both of Cheltenham, England

[73] Assignee: NL Sperry-Sun, Inc., Stafford, Tex.

[21] Appl. No.: 512,308

[22] Filed: Jul. 11, 1983

[30] Foreign Application Priority Data

Jul. 10, 1982 [GB] United Kingdom ..... 8220119

[51] Int. Cl.[3] ..... G01V 1/40

[52] U.S. Cl. ..... 367/85; 367/83; 175/48; 33/307

[58] Field of Search ..... 367/87, 95, 82, 84, 367/35, 83, 85; 340/861, 853; 181/123, 124; 73/861.58, 155; 239/546; 175/45, 48; 33/307; 166/113, 250

[56] References Cited

U.S. PATENT DOCUMENTS

| | | | |
|---|---|---|---|
| 3,736,558 | 5/1973 | Cubberly, Jr. | 367/85 |
| 3,958,217 | 5/1976 | Spinnler | 367/83 |
| 4,184,545 | 1/1980 | Claycomb | 367/85 |
| 4,266,606 | 5/1981 | Stone | 367/85 |

*Primary Examiner*—Nelson Moskowitz
*Assistant Examiner*—Ian J. Lobo
*Attorney, Agent, or Firm*—Carl O. McClenny; William E. Johnson, Jr.

[57] ABSTRACT

A down-hole signal transmitter for a mud pulse telemetry system comprises a flow constrictor defining a throttle orifice for the mud flow, a throttling member displaceable to vary the throughflow cross-section of the throttle orifice, and a pump for displacing the throttling member against the mud flow in order to modulate the mud flow. The displacement of the throttling member is controlled by a hydraulic amplifier, comprising a main pressure relief valve and a subsidiary control valve, and a solenoid to which the output signal of a measuring instrument is supplied. When the main valve is close, the pump displaces a ram, coupled to the throttling member, upwardly. However, when the signal supplied to the solenoid is such as to magnetically attract an armature, the control valve is opened to conduct a small flow of oil between the pump input and the pump output, and this in turn causes the main valve to open thus conducting a much larger flow of oil from the pump input to the pump output and allowing the throttling member to be displaced downwardly by the pressure of the mud flow. The power required to modulate the mud flow with this arrangement is very low and is easily provided by a down-hole electrical generator.

16 Claims, 4 Drawing Figures

APPARATUS FOR SIGNALLING WITHIN A BOREHOLE WHILE DRILLING

BACKGROUND OF THE INVENTION

This invention relates to apparatus for signalling within a borehole while drilling, and is more particularly concerned with a down-hole signal transmitter for a mud-pulse telemetry system.

Various types of measurements-while-drilling (MWD) systems have been proposed for taking measurements within a borehole while drilling is in progress and for transmitting the measurement data to the surface. However to date only one type of system has enjoyed commercial success, that is the so-called mud-pulse telemetry system. In that system the mud stream, which passes down the drill string to the drill bit and then back up the annular space between the drill string and the bore wall with the object of lubricating the drill string and carrying away the drilling products, is used to transmit the measurement data from a down-hole measuring instrument to a receiver and data processor at the surface. This is achieved by modulating the mud pressure in the vicinity of the measuring instrument under control of the electrical output signal from the measuring instrument, and sensing the resultant mud-pulses at the surface by means of a pressure transducer.

It is an object of the invention to provide a generally improved down-hole signal transmitter for a mud-pulse telemetry system.

SUMMARY OF THE INVENTION

According to the invention there is provided a down-hole signal transmitter for a mud-pulse telemetry system, comprising a flow constrictor defining a throttle orifice for the mud flow passing along a drill string, a throttling member displaceable with respect to the throttle orifice to vary the throughflow cross-section of the throttle orifice, a pump for displacing the throttling member against the mud flow, and valve means switchable between a first state in which the throttling member is displaceable by the output pressure of the pump against the mud flow and a second state in which said output pressure is released so as to enable the throttling member to be moved in the direction of the mud flow by the pressure of the mud flow acting on the throttling member, whereby the pressure of the mud flow may be modulated.

Such an arrangement is particularly convenient as it reliably produces the required mud pulses for transmitting measurement data to the surface, whilst being compact and of relatively simple construction.

The invention also provides a down-hole signal generator for a mud-pulse telemetry system, comprising a flow constrictor defining a throttle orifice for the mud flow passing along a drill string, a throttling member displaceable with respect to the throttle orifice to vary the throughflow cross-section of the throttle orifice, actuating means for displacing the throttling member against the mud flow, and change-over means switchable between a first state in which the throttling member is displaceable by the actuating means against the mud flow and a second state in which the throttling member is movable in the direction of the mud flow by the pressure of the mud flow acting on the throttling member, whereby the pressure of the mud flow may be modulated.

DESCRIPTION OF THE PREFERRED EMBODIMENTS

The invention provides a down-hole signal generator for a mud-pulse telemetry system, comprising a flow constrictor defining a throttle orifice for the mud flow passing along a drill string, a throttling member displaceable with respect to the throttle orifice to vary the throughflow cross-section of the throttle orifice, and control means for displacing the throttling member to modulate the mud pressure, wherein the control means incorporates a hydraulic amplifier comprising a main valve and a subsidiary valve for controlling a main flow of fluid through the main valve by acting on a subsidiary flow of fluid of relatively low magnitude.

BRIEF DESCRIPTION OF THE DRAWINGS

In order that the invention may be more fully understood, a preferred form of down-hole signal transmitter in accordance with the invention will now be described, by way of example, with reference to the accompanying drawings, in which.

Figure 1:
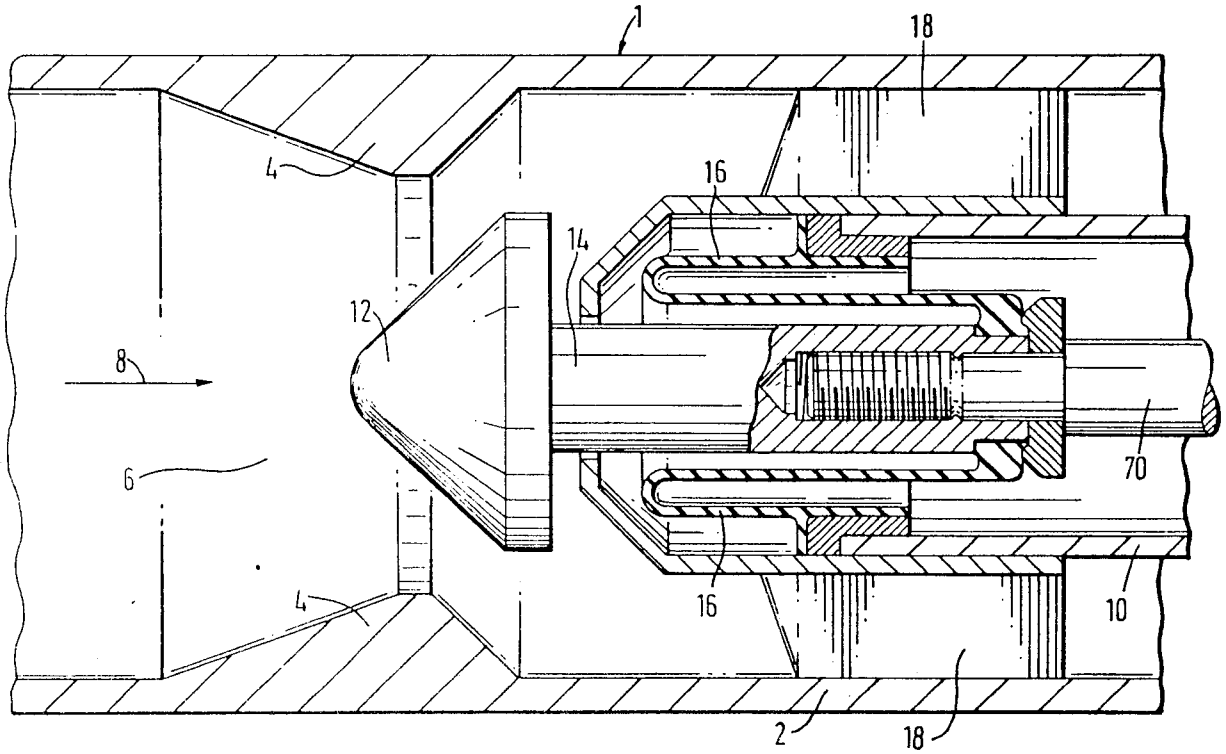
FIG. 1 is a longitudinal section through an upper part of the transmitter.

The signal transmitter 1 illustrated in the drawings is installed in use within a non-magnetic drill collar and coupled to a measuring instrument disposed in an instrument pressure casing installed within the drill collar immediately below the transmitter 1. The drill collar is disposed at the end of a drill string within a borehole during drilling, and the measuring instrument may serve to monitor the inclination of the borehole in the vicinity of the drill bit during drilling, for example. The signal transmitter 1 serves to transmit the measurement data to the surface in the form of pressure pulses by modulating the pressure of the mud which passes down the drill string. The transmitter 1 is formed as a self-contained unit and is installed within the drill collar in such a manner that it may be retrieved, in the event of instrumentation failure for example, by inserting a wireline down the drill string and engaging the wireline with a fishing neck (not shown) on the transmitter, for example by means of a per se known gripping device on the end of the wireline, and drawing the transmitter up the drill string on the end of the wireline.

Referring to FIG. 1, the transmitter 1 includes a duct 2 provided, at its upper end, with an annular flow constrictor 4 defining a throttle orifice 6 for the mud flow passing down the drill string in the direction of the arrow 8. Within the duct 2 is an elongate casing 10 bearing at its upper end, in the vicinity of the throttle orifice 6, a throttling member 12 which is displaceable with respect to the casing 10 in the direction of the axis of the duct 2 to vary the throughflow cross-section of the throttle orifice 6. The throttling member 12 is provided with a shaft 14 which extends into the casing 10, the space within the casing 10 being filled with hydraulic oil in order to ensure hydrostatic pressure balance and being sealed at its upper end by a Viton diaphragm 16 extending between the inside wall of the casing 10 and the shaft 14. The casing 10 is rigidly mounted within the duct 2 by three upper support webs 18 and three lower support webs (not shown) extending radially between the casing 10 and the duct 2, so as to provide an annular gap between the casing 10 and the duct 2 for mud flow.

Figure 2:
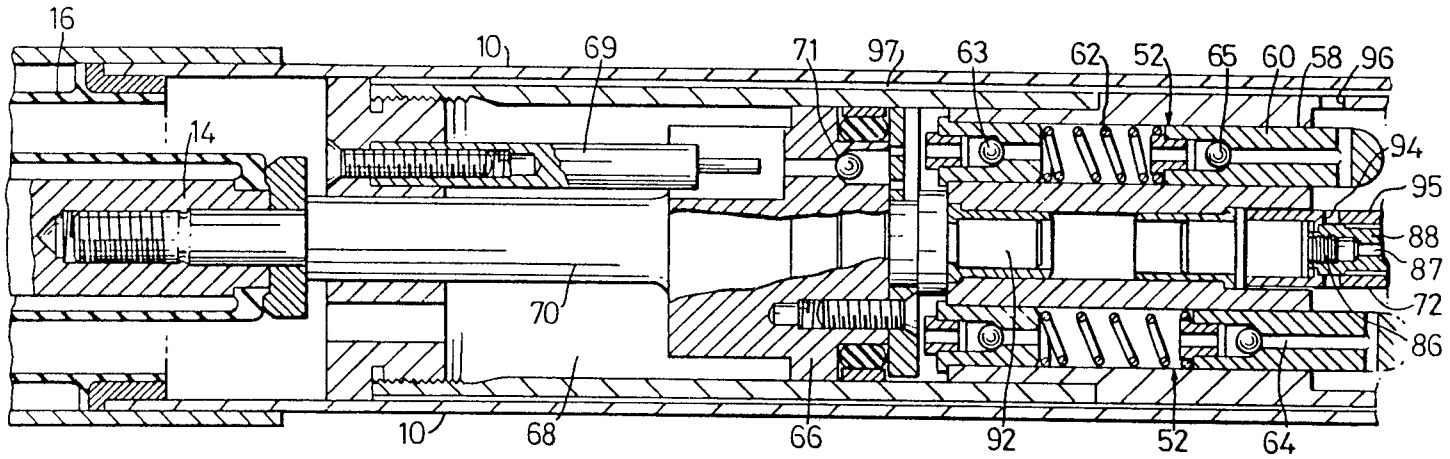
FIG. 2 is a longitudinal section through a further part of the transmitter immediately below the upper part, with the outer duct omitted.
Figure 3:
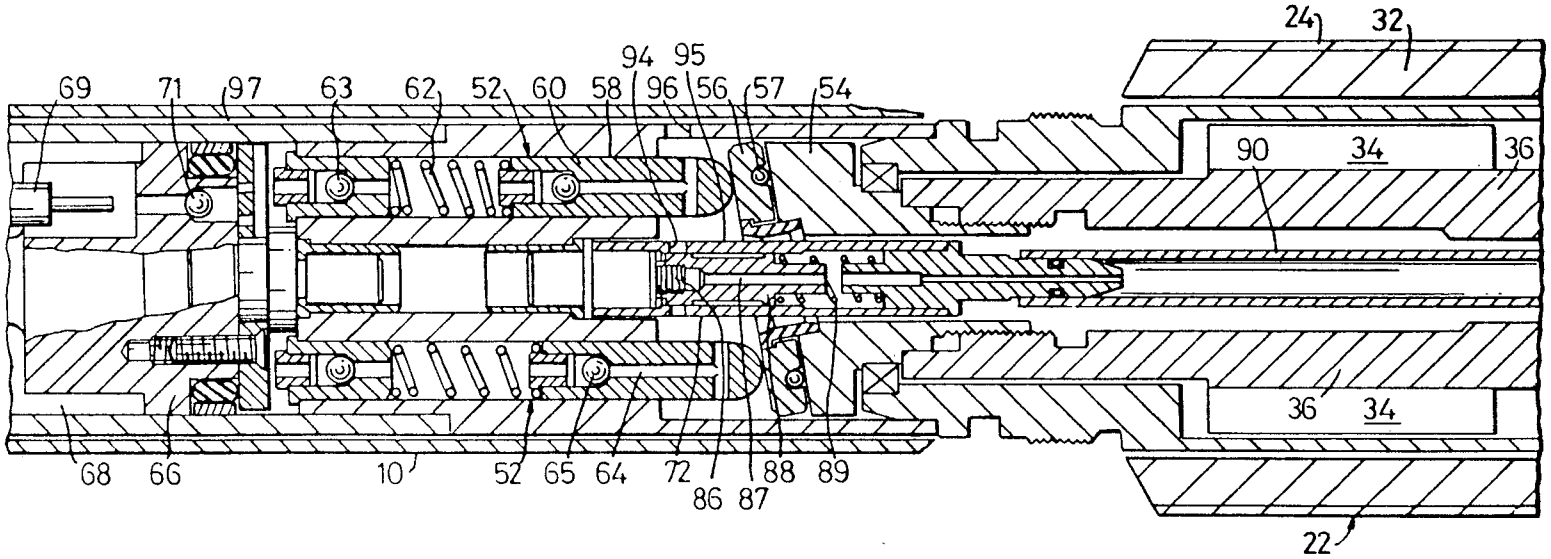
FIGS. 3 and 4 are longitudinal sections through lower parts of the transmitter, with the outer duct omitted.
Figure 4:
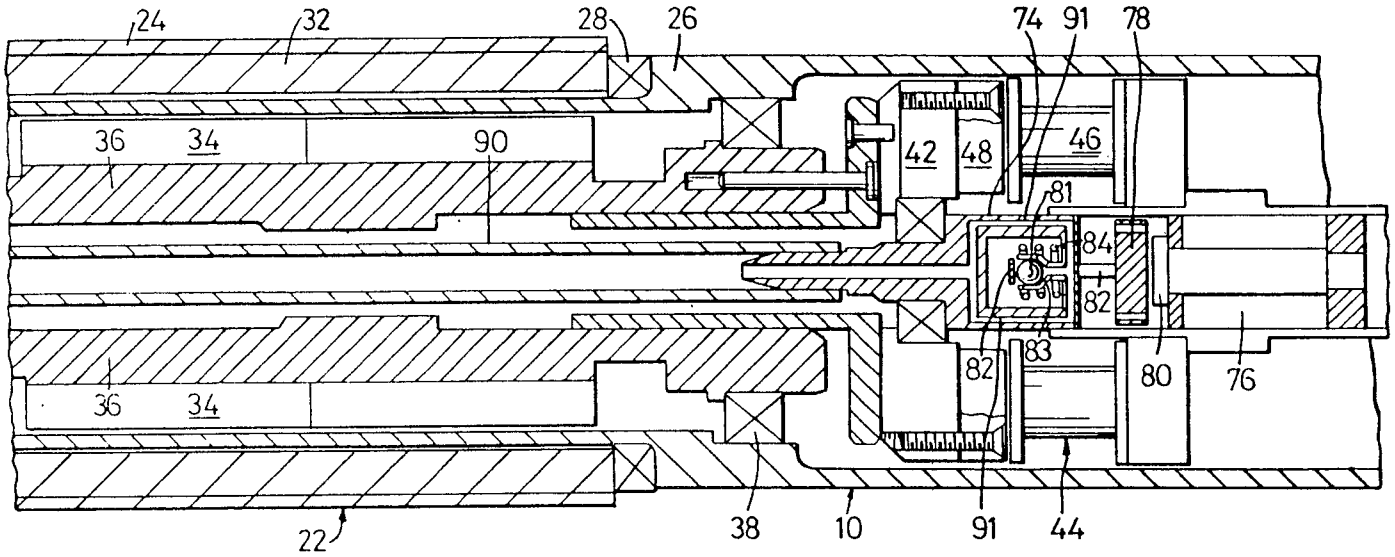

Referring to FIGS. 2 to 4, in which the duct 2 has been omitted, an annular impeller 22 having a series of blades 24 distributed arounds its periphery and angled to the mud flow surrounds the casing 10, and is carried on a shoulder 26 of the casing 10 by means of a filled PTFE (polytetrafluoroethylene) thrust bearing 28. The blades 24 are mounted on a copper drive ring 32. A rare earth magnet assembly 34 is carried by an annular shaft 36 rotatably mounted within the casing 10 by means of bearings such as 38, and incorporates six Sm-Co (samarium-cobalt) magnets distributed about the periphery of the shaft 36. Three of the magnets have their North poles facing radially outwardly and a further three of the magnets, alternating with the previous three magnets, have their South poles facing radially outwardly. As the impeller 22 rotates in the mud flow, eddy currents will be induced in the copper drive ring 32 by the intense magnetic field associated with the six Sm-Co magnets, and the magnet assembly 34 and hence the shaft 36 will be caused to rotate with the impeller 22 by virtue of the interaction between the magnetic field associated with the magnets and the magnetic field associated with the eddy currents induced in the drive ring 32.

The annular shaft 36 drives a rotor 42 of an electrical generator 44 (FIG. 4) for supplying power to the measuring instrument. The generator 44 is a three-phase a.c. generator comprising a wound stator 46 having six poles equally spaced around the axis of the generator 44, and the rotor 42 incorporates eight Sm Co magnets 48 also equally spaced around the axis of the generator 44, four of the magnets 48 having their North poles facing the stator 46 and a further four of the magnets 48, alternating with the previous four magnets 48, having their South poles facing the stator 46. In addition the annular shaft 36 drives a hydraulic pump 52 (FIGS. 2 and 3) by way of an angled swashplate 54 and an associated piston thrust plate 56 provided with a bearing race 57.

The hydraulic pump 52 comprises eight cylinders 58 extending parallel to the axis of the casing 10 and arranged in an annular configuration, and a respective piston 60 associated with each cylinder 58. The lower end of each piston 60 is permanently biased into engagement with the thrust plate 56 by a respective piston return spring 62, so that rotation of the swashplate 54 with the shaft 36 will cause the pistons 60 to axially reciprocate within their cylinders 58, the eight pistons 60 being reciprocated cyclically so that, when one of the pistons is at the top of its stroke, the diametrically opposing piston will be at the bottom of its stroke and vice versa. Each cylinder 58 is provided with a non-return valve 63 at its upper end, and each piston 60 is provided with a bore 64 incorporating a further non-return valve 65. The valve 65 opens at the bottom of each stroke of the piston 60 to take in hydraulic oil, and the valve 63 opens at the top of each stroke of the piston 60 to output hydraulic oil to the lower side of a ram 66 disposed within a cylinder 68. The outputs of the cylinders 58 are supplied to the ram 66 cyclically and the ram 66 is coupled to the shaft 14 of the throttling member 12 by an output shaft 70, so that the throttling member 12 may be displaced upwardly by the pump 52 to decrease the throughflow cross-section of the throttle orifice 6. Furthermore, as the ram 66 reaches the top of its stroke within the cylinder 68, a push rod 69 attached to the upper wall of the cylinder 68 opens a non-return valve 71 extending through the ram 66 with the result that the upper and lower parts of the cylinder 68 are placed in fluid communication and the pressure is equalised on th two sides of the ram 66.

The throttling member 12 may be subsequently displaced downwardly to increase the throughflow cross-section of the throttle orifice 6 under pressure of the mud flow acting on the throttling member 12 when the hydraulic pressure acting on the lower side of the ram 66 is relieved. This pressure relief is achieved by a hydraulic amplifier comprising a main pressure relief valve 72 (FIGS. 2 and 3) and a subsidiary control valve 74 (FIG. 4) operable by an actuator in the form of a solenoid 76 under control of the output of the measuring instrument. More particularly, when the form of the output signal from the measuring instrument is such as to break the magnetic attraction between an armature 78 and an end plate 80 of the solenoid 76, a U-shaped member 82 having both its ends connected to the armature 78 is displaced under the action of a spring 84 so as to allow a ball 81 of the control valve 74 to be raised from its seating 83 by fluid pressure, thereby opening the control valve 74. This has the effect of enabling a small flow of oil which passes through a constrictor 86 within a bore 87 extending through a valve member 88 of the pressure relief valve 72 and is conducted to the control valve 74 by way of a duct 90 extending along the axis of the annular shaft 36 and two branch conduits 91.

The action of initiating the flow of oil through the constrictor 86 causes the valve member 88 to be displaced downwardly against the action of a spring 89 due to the pressure differential across the pressure relief valve 72 which is established by the flow of oil through the constrictor 86. This results in apertures 94 in the form of spark-eroded slits in an outer sleeve 95 of the valve 72 being uncovered by the valve member 88 and a flow of oil through the apertures 94 being initiated, the oil being supplied to the pressure relief valve 72 from the lower part of the cylinder 68 by way of a duct 92. It will be appreciated from what has been said above that a main flow of oil through the pressure relief valve 72 is controlled by the control valve 74 acting on a subsidiary flow of oil of relatively low magnitude, so that the two valves 72 and 74 act as a hydraulic amplifier controlled by the output of the measuring instrument.

When the pressure relief valve 72 is open the output of the pump 52 is fed back directly to the pump input by way of the duct 92, and the hydraulic pressure acting on the lower side of the ram 66 is relieved. This enables the ram 66 to be displaced downwardly within the cylinder 68 by the mud flow acting on the throttling member 12 with oil being supplied to the upper part of the cylinder 68 by way of an aperture 96, an annular passage 97 and a further aperture 98 in the wall of the cylinder 68, and with the non-return valve 71 being closed as the ram 66 is displaced.

When the form of the output signal of the measuring instrument changes so that the armature 78 is attracted to the end plate 80 of the solenoid 76, the U-shaped member 82 is displaced against the action of the spring 84 so as to seat the ball 81 of the control valve 74 on the seating 83, thus closing the control valve 74, and the flow of oil through the constrictor 86 in the valve member 88 of the pressure relief valve 72 is stopped. This causes the valve member 88 to be displaced upwardly by the spring 89, thus closing the valve 72 and preventing feedback of oil directly from the output to the input of the pump 52. Thus the full output of the pump 52 is again applied to the underside of the ram 66 and the ram 66 is displaced upwardly.

It will be appreciated therefore that, if the measurement data from the measuring instrument is arranged to suitably vary the current passing through the solenoid 76 so as to intermittently attract the armature 78 to the end plate 80 of the solenoid 76, the throttling member 12 will be displaced in such a manner as to modulate the pressure of the mud flow upstream of the throttle orifice 6 in dependence on the measurement data. Thus a series of pressure pulses corresponding to the measurement data will travel upstream in the mud flow and may be sensed at the surface by a pressure transducer in the vicinity of the output of the pump generating the mud flow.

We claim:

1. A down-hole signal transmitter for a mud-pulse telemetry system, comprising a flow constrictor defining a throttle orifice for the mud flow passing along a drill string, a throttling member displaceable with respect to the throttle orifice to vary the throughflow cross-section of the throttle orifice, a pump for displacing the throttling member against the mud flow, and valve means switchable between a first state in which the throttling member is displaceable by the output pressure of the pump against the mud flow and a second state in which said output pressure is relieved so as to enable the throttling member to be moved in the direction of the mud flow by the pressure of the mud flow acting on the throttling member, whereby the pressure of the mud flow may be modulated, wherein the valve means comprises a hydraulic amplifier incorporating a main, pressure relief valve and a subsidiary, control valve for controlling a main flow of fluid through the main valve by acting on a subsidiary flow of fluid of relatively low magnitude, the pressure relief valve being adapted to open when the control valve is opened and comprising a spring-biased valve member having a bore extending therethrough for the subsidiary flow of fluid towards the control valve, and the valve member being movable by pressure of fluid acting against the spring force when the control valve is opened, to open the pressure relief valve.

2. A down-hole signal transmitter for a mud-pulse telemetry system, comprising a flow constrictor defining a throttle orifice for the mud flow passing along a drill string, a throttling member displaceable with respect to the throttle orifice to vary the throughflow cross-section of the throttle orifice, and control means for displacing the throttling member to modulate the mud pressure, wherein the control means is disposed in a mud-free environment within a mud pulse telemetry tool, and incorporates a pump for displacing the throttling member aginst the mud flow, and change-over means switchable between a first state in which the output pressure of the pump is applied to the throttling member so as to displace the throttling member against the mud flow and a second state in which the pressure applied to the throttling member is relieved so as to enable the throttling member to be moved in the direction of the mud flow by a pressure of the mud flow acting on the throttling member and without application of output pressure from the pump in said direction, whereby the pressure of the mud flow may be modulated.

3. A transmitter according to claim 2 wherein the change-over means comprises valve means switchable between a first state in which the throttling member is displaceable against the mud flow by the output pressure of the pump and a second state in which said output pressure is relieved so as to enable the throttling member to be moved in the direction of the mud flow by the pressure of the mud flow acting on the throttling member.

4. A transmitter according to claim 3, wherein an electrical actuator is provided for controlling the valve means in response to an electrical output signal from a measuring instrument.

5. A transmitter according to claim 4, wherein the electrical actuator is a solenoid.

6. A transmitter according to claims 2 or 3, wherein the valve means comprises a pressure relief valve which, when open, couples the output of the pump directly to the pump input.

7. A transmitter according to claim 3 wherein the valve means comprises a hydraulic amplifier incorporating a main, pressure relief valve and a subsidiary, control valve for controlling a main flow of fluid through the main valve by acting on a subsidiary flow of fluid of relatively low magnitude.

8. A transmitter according to claim 7, wherein the pressure relief valve is adapted to open when the control valve is opened.

9. A transmitter according to claim 8, wherein the pressure relief valve comprises a spring-biased valve member having a bore extending therethrough for the subsidiary flow of fluid towards the control valve, and movable by pressure of fluid acting against the spring force when the control valve is opened, to open the pressure relief valve.

10. A transmitter according to claim 9, wherein the valve member is disposed within an outer sleeve having at least one aperture extending therethrough, and is movable, when the control valve is opened, between a first position in which the or each aperture is covered by the valve member and a second position in which the or each aperture is uncovered by the valve member to enable the main flow of fluid therethrough.

11. A transmitter according to any one of claims 7 to 10, wherein an actuating member is movable by being magnetically attracted by a solenoid, when an appropriate switching signal is applied to the solenoid, in order to close the control valve.

12. A transmitter according to claim 2 wherein a ram is provided for displacing the throttling member upwardly when the output pressure of the pump is applied to the underside of the ram, and at least one pressure-equalizing aperture serves to place the upper side of the ram in fluid communication with the lower side of the ram when the ram approaches the top of its stroke.

13. A transmitter according to claim 2, wherein the pump incorporates a plurality of cylinders having pistons arranged to be driven cyclically, and a valve arrangement for discharging the output of each cylinder at an appropriate point in the stroke of the associated piston.

14. A transmitter according to claim 13, wherein each piston has a bore extending therethrough for connecting the input of the pump to the associated cylinder, and a further valve arrangement is provided for supplying an input to each cylinder by way of the bore in the associated piston at an appropriate point in the stroke of the piston.

15. A transmitter according to claim 2, wherein the pump is disposed in a mud-free environment within a casing and is arranged to be driven by an impeller positioned in the mud flow passing along the drill string and magnetically coupled to the pump to impart driving torque thereto.

16. A transmitter according to claim 15, wherein an electrical generator disposed in a mud-free environment within the casing is also arranged to be driven by the impeller.

* * * * *